United States Patent [19]

Heimann et al.

[11] 4,342,472

[45] Aug. 3, 1982

[54] CONTINUOUS FORM MULTIPLE PLY TICKET ASSEMBLY

[75] Inventors: Edward W. Heimann, Woodridge; Donald J. Steidinger, Barrington, both of Ill.

[73] Assignee: Wallace Business Forms, Inc., Hillside, Ill.

[21] Appl. No.: 108,850

[22] Filed: Dec. 31, 1979

[51] Int. Cl.[3] ..... B41L 1/20

[52] U.S. Cl. ..... 282/11.5 A; 229/69

[58] Field of Search ..... 282/11.5 R, 115 A, 12 R, 282/12 A, 21 R; 281/2; 229/69

[56] References Cited

U.S. PATENT DOCUMENTS

| | | | |
|---|---|---|---|
| 3,104,799 | 9/1963 | Steidinger | 229/69 |
| 3,554,438 | 1/1971 | Van Malderghem | 282/11.5 A X |
| 4,108,352 | 8/1978 | Peschke | 282/11.5 A X |
| 4,113,281 | 9/1978 | Halse | 282/11.5 A |
| 4,239,114 | 12/1980 | Denay | 229/69 X |

*Primary Examiner*—Paul A. Bell
*Assistant Examiner*—John S. Brown
*Attorney, Agent, or Firm*—Tilton, Fallon, Lungmus & Chestnut

[57] ABSTRACT

A continuous form multiple ply ticket assembly wherein the plies interior of the top and bottom plies are captured in at least one control margin and are shorter in each ticket panel than the corresponding top and bottom ply ticket panels to provide a fold space, and at least one line of weakness in the top and bottom plies in the fold space extending transversely of each ticket panel generally aligned with one of the transverse edges of the assembly of interior plies.

14 Claims, 8 Drawing Figures

FIG. 1
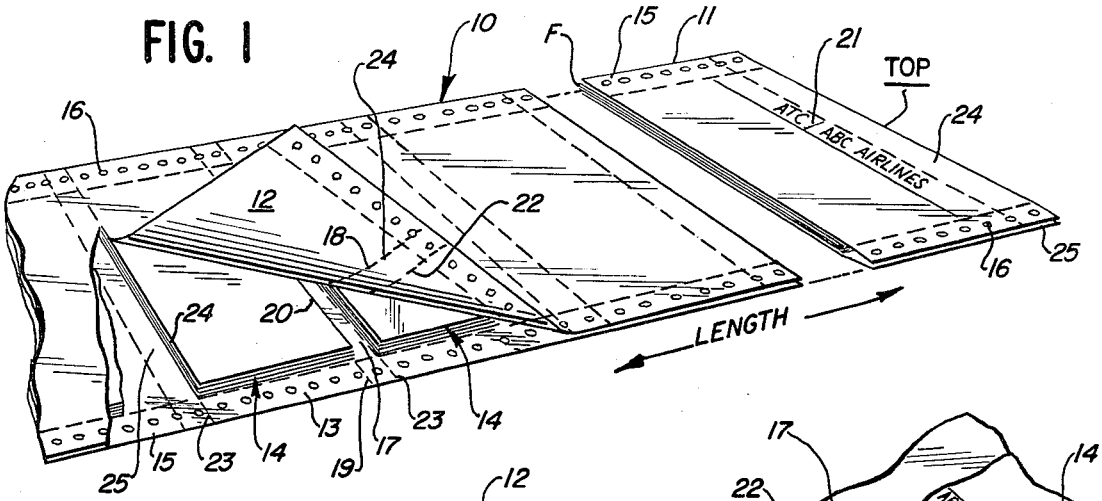
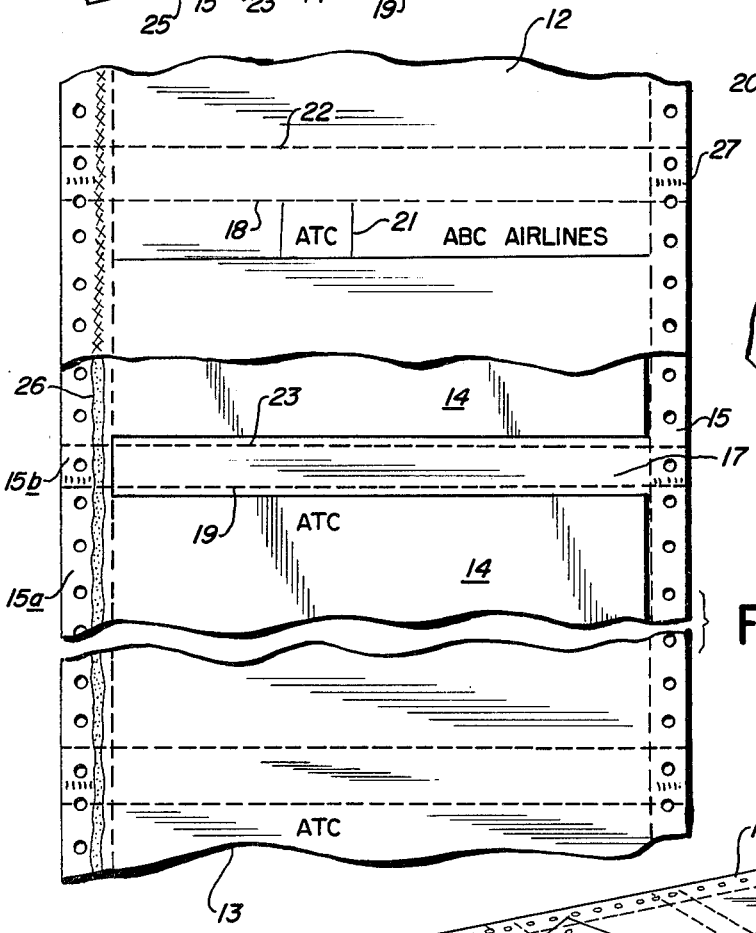
FIG. 2
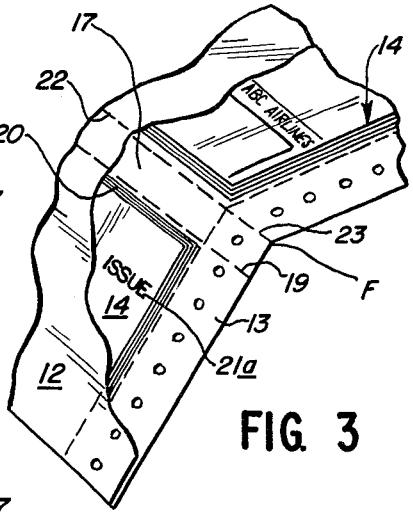
FIG. 3
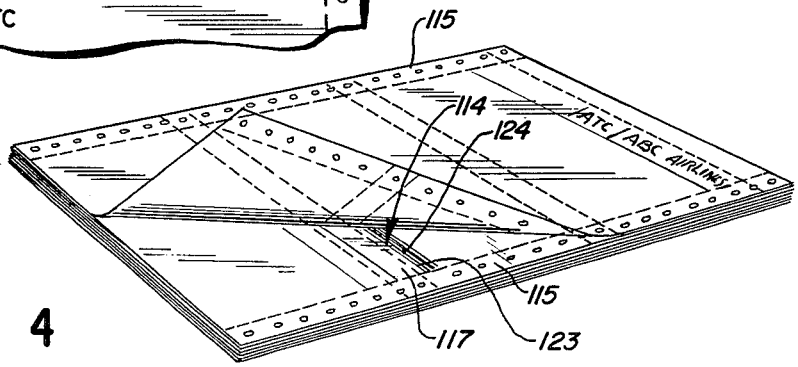
FIG. 4

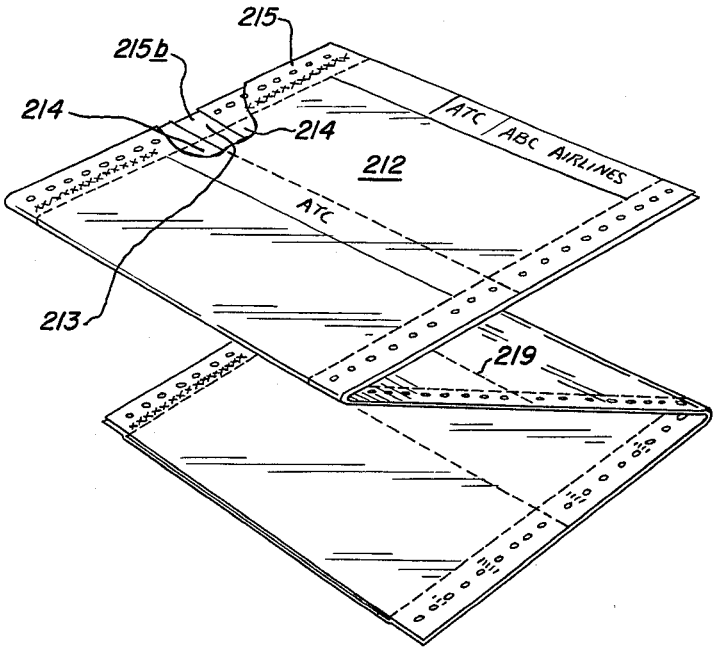
FIG. 5
FIG. 6
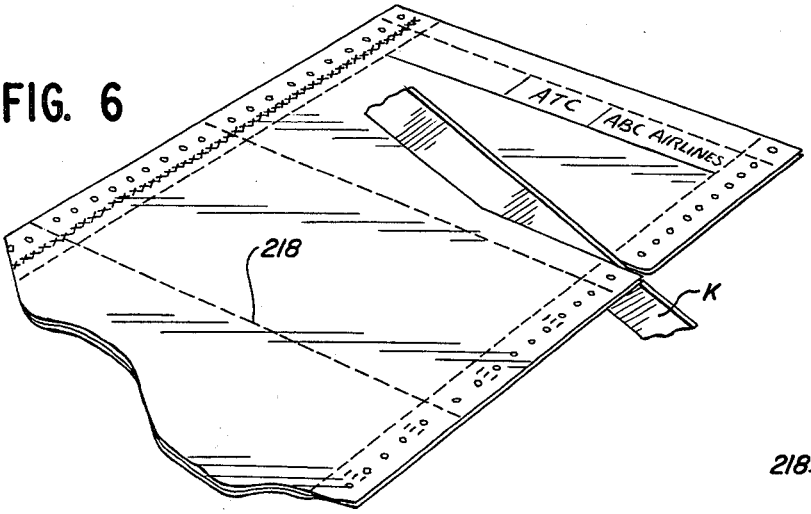
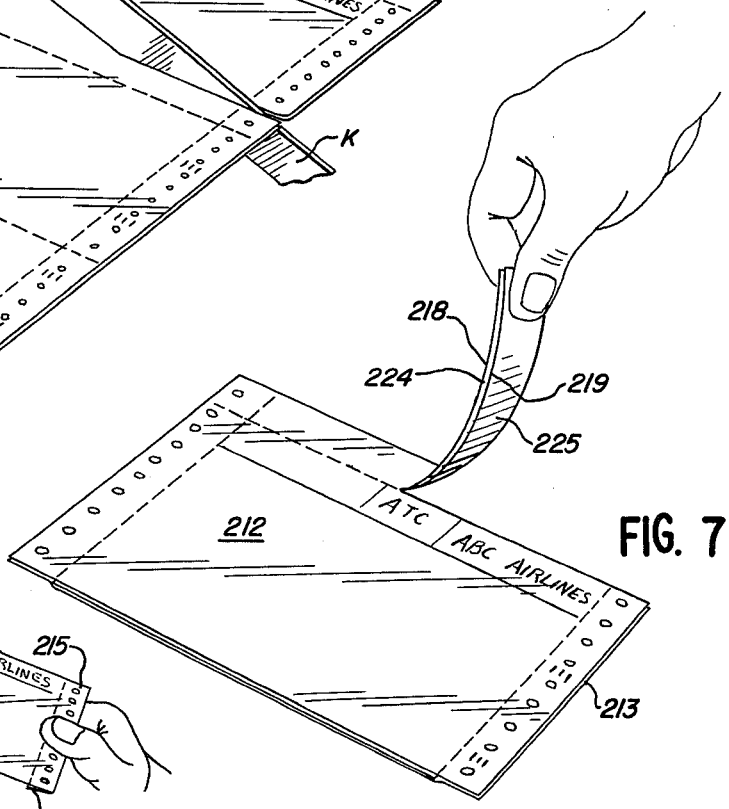
FIG. 7
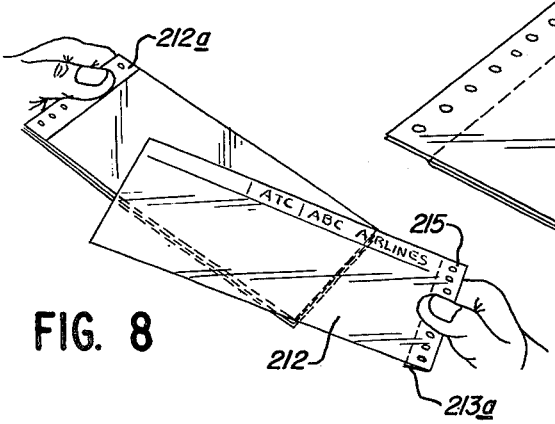
FIG. 8

CONTINUOUS FORM MULTIPLE PLY TICKET ASSEMBLY

BACKGROUND AND SUMMARY OF INVENTION

This invention relates to a continuous form multiple ply ticket assembly and, more particularly, to an assembly suited for typewriter type printing.

For many years the ticket used by airlines were the familiar individual booklet style with the several plies bound in a stub on one narrow end and with a perforation to remove each ply individually from the stub as it was needed. These tickets were typically handwritten.

The Air Transport Association (ATA) began work to develop an automated ticket that could be processed by computers and would be standardized so that all the various airlines could develop computer ticket processing systems that would function with tickets issued by any airline. This work led to the development of specifications for the automated ticket (AT). This ticket used a magnetic strip on the back of the ticket to record various data that could then be read by computers in processing the used tickets. Technology was not available at the time to implement the automated ticket system and other problems became apparent with this system which made it undesirable to implement at that time.

The ATA then prepared a specification for a Transitional Automated Ticket (TAT) to be used for some years until the AT could be implemented. The TAT has become the major ticket used in high volume issuing stations such as airline ticket counters in airports. Tickets for this application are known in the patent art as Herz U.S. Pat. No. 3,877,728 and Steidinger U.S. Pat. No. 4,109,936. The computer equipment to issue tickets of this type is relatively expensive and therefore economically suited to the high volume issuing stations. There was also a need for tickets that could be computer issued by small volume ticket counters, travel agencies, and the like. The 14,000 agency locations issue more tickets in total than are issued at airline ticket counters.

The first printer for this need was made by the Teletype Corporation and tickets for it were called Teletype Tickets or remote terminal printer tickets (RTPT). Later, many companies made printers for this application. The RTPT are a continuous series of multiple plies folded into a pack. It differs fundamentally from the tickets of Herz and Steidinger in that the joining stub is parallel to the length of the series whereas Herz and Steidinger have a transverse stub. This difference leads to many important requirements in the ticket construction. The "length" or longitudinal dimension as referred to herein refers to the dimension in the direction of the continuous web—therefore in an individual ticket the length is 3¼", while the transverse dimension (relative to the direction of web movement), i.e., the "width" is 8". In operation, the Herz/Steidinger type of ticket was printed by applying characters across a transverse line which intersected several sentences or information groups as contrasted to the printing of a single sentence or information group on the normal typewriter.

The first Teletype printer provided pinfeed devices located above the computer printing mechanism to feed the continuous tickets. These tickets still are issued by the computer on demand. When a traveler orders a ticket, the travel agent prepares the ticket using specific flights, dates, etc. The ticket is then separated from the continuous series of tickets. With the pinfeed located above the computer printing mechanism the tickets were 7" long in order that the last line of the ticket could be printed and then the ticket ejected beyond the pinfeed device so it could be separated from the series. The ticket was and still is only 3¼" long so at that time more than ½ of the ticket form was torn off and thrown away as waste.

The next development was to install the pinfeed device below the computer printing mechanism—but this still required an excess of at least 1/6". This permitted the last line of the ticket to be printed, the ticket ejected being 3¼" plus 1/6" or more. It is very difficult to remove a waste strip as narrow as 1/6" that consists of 6 to 12 plies of paper so a more practical dimension of 182" is usuallly used. This results in a ticket 4" long with a ¾" waste strip and a 3¼" long ticket.

This ticket is the present state of the art. It is used by many airlines. It has several major defects that make its function less than desired. The many plies glued in one margin result in wrinkling and tenting of the continuous series when folded into a pack. Wrinkles and tenting result in misregistration of the various plies, feeding difficulties and failures in computer processing the used tickets, and it is difficult for the agent to separate the ticket from the continuous series and to remove the waste stub without damage to the useable portion of the ticket. A different approach is seen in U.S. Pat. Nos. 4,113,281 and 4,123,086 where assemblies were detached from a continuous bottom ply which was then used to initiate feeding.

It is an object of this invention to provide airline tickets that can be used on existing Teletype printers and also impact and special computer printers and new printers currently under development. To this end, the invention provides a series of connected tickets made up of multiple plies wherein the interior plies are captured in the control margin along at least one longitudinal edge, the interior plies having a longitudinal dimension shorter than that of the top and bottom plies to provide a "window" or a fold space and at least one line of weakness being in each fold space generally aligned with the transverse edges of the interior plies. The provision of the shorter interior plies, i.e., those providing the "windows", brings about a number of advantageous results. First, the invention makes possible the typing and removal of the tickets on existing Teletype printers and like printers as referred to in the preceding object.

Through the provision of the shorter intermediate plies, the transverse ticket edges on these plies can be registered more accurately on the optical scanners employed for high speed interline ticket accounting and reconciliation. This stems from the fact that a precisely located clean cut edge is provided rather than a hand torn perforation. This enhances accuracy and reliability in optical scanning reconciliation.

The practice of the invention reduces the number of plies in the waste strip to be separated from the ticket which, in addition to saving paper, provides less waste to be disposed of at the counter and an easier-to-tear margin. In this connection, the waste strip associated with the ticket can be removed in one easy motion by the ticket agent. And yet, the smooth continuous covering ply for both top and bottom of the ticket assembly provides trouble-free feeding of the continuous ticket through the pinfeed and printer positions of the computer.

The provision of the shorter interior plies, i.e., those providing the windows, also makes possible a substantial improvement in folding so as to at least minimize tenting and wrinkling and, according to certain modifications of the invention, completely eliminating these objections.

The invention is described in conjunction with the accompanying drawing, in which FIG. 1 is a fragmentary perspective view, partially broken away of a ticket assembly constructed according to the instant invention;

FIG. 2 is a fragmentary top plan view with certain portions of the ticket assembly broken away so as to better reveal the details of construction and operation;

FIG. 3 is a fragmentary perspective view of a portion of two interconnected ticket assemblies showing the disposition of the same when being folded;

FIG. 4 is a view essentially similar to FIG. 1 but showing a modified form of the invention;

FIG. 5 is a fragmentary perspective view of yet another modification of the invention in partially folded condition;

FIG. 6 is a fragmentary perspective view showing the modification of FIG. 5 in the process of being transversely severed to provide an individual ticket packet;

FIG. 7 is another perspective view of the modification of FIGS. 5 and 6 showing the removal of the waste or tear strip; and FIG. 8 is another perspective view showing the subsequent step of top ply and control margin removal.

With reference first to FIG. 1, the numeral 10 designates generally a continuous form multi-ply ticket assembly. One separated ticket packet is seen at the upper right and is designated 11. It will be appreciated that such ticket assemblies are normally provided in zig-zag folded condition—see FIG. 5 for example—where the folding occurs after every second (or third) ticket packet. The series of connected tickets includes a top ply 12 (see also FIG. 2), a bottom ply 13 and an assembly generally designated 14 of interior plies, the top and interior plies being equipped with carbon spot backing to convey printing to underlying plies.

Reference to FIG. 1 reveals that the interior ply assemblies 14 are shorter than the top and bottom plies 12 and 13—again, the length dimension being that of the connected series and is so indicated with respect to FIG. 1.

In the illustration given in FIG. 1, the top and bottom plies are equipped with the usual control margins 15 which in turn are equipped with line holes as at 16—these being employed for advancing the ticket through the computer printer. Also in the embodiment of FIGS. 1–3, the assemblies 14 of interior plies are not as "wide" as the top and bottom plies, terminating for example short of the right hand control margin 15. The interior plies, however, do extend into the left hand control margin as indicated at 15*a* in FIG. 2. More particularly, the embodiment of FIGS. 1–3 features the interior plies as being continuous along the left hand control margins—as at 15*b*. However, inward of the left hand control margin, the interior plies are discontinuous to provide a fold space 17.

This can be appreciated even more from a consideration of an alternative form in FIG. 4 where the fold space 117 is literally a "window" developed by removing a chip from each intermediate ply at longitudinally spaced apart intervals. In the modification of FIG. 4, the interior plies are continuous in both control margins 115. The continuity of the intermediate plies in either or both of the control margins is not critical to the practice of the invention, as will be brought out hereinafter.

As can be appreciated from a consideration of FIG. 1, each of the top and bottom plies 12 and 13, respectively, are equipped with aligned transverse lines of weakening as at 18 and 19, respectively. These lines of weakening (perforations in the illustration given) are generally aligned with the top transverse edge 20 of the interior ply assembly 14. By "top", reference is made to the portion designated TOP in the right hand portion of FIG. 1 which emerges first from the typewriter-like printer and which is positioned uppermost when a reader orients the ticket for reading the printed indicia as at 21 in FIG. 1 (or 21*a* in FIG. 3). Thus, the lines of weakness 22, 23 emerge before the lines 18, 19. It will be appreciated that the various plies are equipped with a great deal of printed indicia before assembly corresponding to the various information that is normally provided on an airline ticket. However, most of this information has been omitted so as to more clearly present the invention.

The function of the aligned lines of weakness 18 and 19 can be appreciated from a consideration of the second drawing sheet which features a third embodiment—the second embodiment being seen in FIG. 4. In FIG. 7, the action of removing the waste strip from a separated ticket is illustrated. This separates a portion of the top ply 212 along the line of weakness 218 and a similar portion from the bottom ply 213 along the line of weakness 219. In the embodiment of FIGS. 5–7, the separation of one ticket packet from another is achieved by a knife or guillotine as at K (see FIG. 6) and this is one respect in which the embodiment of FIGS. 5–7 differs from the embodiments of FIGS. 1–3, and 4.

Referring again to the embodiment of FIGS. 1–3, it will be noted that a second pair of aligned lines of weakness are provided in the top and bottom plies. More particularly, the top ply 12 has a second line of weakness as at 22 and the bottom ply 13 has a second line of weakness as at 23. As can be appreciated from a consideration of FIG. 1, the second lines of weakness 22, 23 are generally aligned with what could be considered the bottom 24 of the interior ply assembly 14.

These second lines of weakness 22, 23 constitute the transverse line about which folding can occur—as is illustrated in FIG. 3 where the partial fold is designated by the letter F. However, by the provision of two sets of lines of weakness (18, 19 and 22, 23) the folding can just as well occur on the other set, i.e., 18, 19. Normally, the series of tickets of FIGS. 1–3 are zig-zag folded into the configuration depicted in FIG. 5 and about the various fold lines F.

In operation, after the specific passenger information has been printed by a computer on a ticket while it is still connected, the individual ticket is separated from the continuous series by tearing the ticket along the aligned lines of weakness 22, 23 (also the fold line F) and this is so indicated at the top central portion of FIG. 1. This results in a completed ticket packet which has along its upper transverse edge a waste section consisting of a portion of 24 of the top ply and an aligned portion 25 of the bottom ply (as at 224 and 225 in FIG. 7). These are then removed to provide a ticket which now has no waste section at the transverse edge. Depending upon the type of printer employed, the top ply may or may not be removed. Usually, one or more intermediate plies are also removed by the ticket agent for record purposes.

In FIG. 8, the agent is seen in the process of further preparation of the ticket for presentation to the passenger. This is achieved by grasping the top ply 212 and the right marginal portion of the bottom ply as at 213*a* with the right hand—and grasping the left hand marginal portion of the top ply as at 212*a* along with the interior and bottom plies with the left hand, separating the two grasped portions by a snap apart motion. Remaining for presentation to the passenger is a ticket consisting of one or more intermediate plies and the bottom ply.

All of the intermediate plies have transverse edges which have been trimmed prior to assembly, i.e., there is no ragged edge resulting from perforation which could interfere with the reconcillation performed by the optical scanner. The bottom ply 13 (or 213 as the case may be) does have the ragged edge resulting from perforation but this ply is never used as a ticket ply—usually being the receipt ply retained by the passenger. In some instances it may also carry the terms and conditions of flight, i.e., those governing liability for loss of baggage, etc. Thus, the retention of the bottom ply with a relatively ragged edge does not interfere with any optical scanning.

By reducing the number of plies in the waste strip to be separated from the ticket, i.e., the portions 224 and 225 of FIG. 7, there is less waste to be disposed of at the counter and a much easier to tear margin. Also, this minimizes tenting and wrinkling inasmuch as the interior plies are continuous only in a narrow portion in the left hand margin 15*a* of the embodiment of FIGS. 1–3. Tenting and wrinkling can be completely eliminated if the discontinuity of the intermediate plies extends all the way across the width thereof as at 215*b* in FIG. 5. In FIG. 5, a portion of the top ply 212 has been cut away to reveal the interior ply assemblies 214 which are seen to be discontinuous although still fastened in the left hand margin 215. Thus, only two web thicknesses extend around the fold line which eliminates tenting and wrinkling as well as effecting a saving of paper. The various plies are fastened together by means of glue lines as at 26 in the left hand margin (see FIG. 2) and optimally crimping relative to the various plies as at 27 in the right upper portion of FIG. 2.

The embodiment of FIGS. 5–7 is employed for a different kind of computer printer than those of FIGS. 1–4—the computer printer of the ticket of FIGS. 5–7 being equipped with a cutoff device K. Thus, only the aligned lines of weakness 218, 219 need be provided and in this instance, folding is provided around the first pair of lines 218, 219 rather than about the second pair of lines of weakness 22, 23 of the embodiment of FIGS. 1–3.

In all of the modifications, it has been found advantageous to position the lines of weakness slightly offset from the transverse edges of the interior plies. This can be appreciated particularly from the showings in FIGS. 2–4 where the lines of weakness are spaced a slight distance into the fold space, i.e., of the order of 1–3 mm. (alternatively approximately 1/32"–⅛"). This insures that the interior plies do not extend right into the fold zone.

Thus, even in the embodiment of FIG. 4 where the interior plies of the assembly 114 extend into the control margins 115, the bottom edges 124 of the central portions of the intermediate plies are spaced from the transverse line of weakness 123 so as to preserve their sharp edge, crisp nature for optical scanning and also minimize the problems of tenting and wrinkling.

While in the foregoing specification a detailed description of the invention has been set down for the purpose of illustration, many variations of the details hereingiven may be made by those skilled in the art without departing from the spirit and scope of the invention.

We claim:

1. A series of connected tickets comprising elongated coextensive top and bottom plies equipped with aligned control margins along at least one longitudinally-extending edge thererof and providing a succession of packets defining individual tickets, an interior ply assembly for each ticket packet between said top and bottom plies and captured in the control margin along one longitudinally-extending edge, each interior ply assembly having a longitudinally-extending dimension shorter than the longitudinally-extending dimension of the top and bottom plies of its associated packet to provide a fold space defined by transverse edges of adjacent assemblies, and at least one line of weakness in said top and bottom plies in said fold space extending transversely of each packet generally aligned with at least one of said transverse edges, whereby the portions of said top and bottom plies in said fold space provide a waste strip to permit removal of a ticket upon demand without sacrifice of full printing of the succeeding ticket.

2. The structure of claim 1 in which said line of weakness is positioned in said fold space a slight distance from said one transverse edge.

3. The structure of claim 2 in which said distance is of the order of 1–3 mm.

4. The structure of claim 1 in which said interior ply assembly is discontinuous in the control margin along said one longitudinally-extending edge.

5. The structure of claim 4 in which said interior ply assembly has a longitudinally-extending dimension in said one control margin equal to the longitudinally-extending dimension thereof inward of said control margin.

6. The structure of claim 1 in which said interior ply assembly is continuous in said control margin along said one longitudinally-extending edge.

7. The structure of claim 1 in which said top and bottom plies are equipped with control margins along both longitudinally-extending edges, said interior ply assembly being captured in both margins.

8. A series of connected tickets comprising elongated coextensive top and bottom plies equipped with aligned control margins along at least one longitudinally-extending edge thereof and providing a succession of packets defining individual tickets, an interior ply assembly for each ticket packet between said top and bottom plies and fastened in the control margin along one of the longitudinally-extending edges, each interior ply assembly having a longitudinally-extending dimension shorter than the longitudinally-extending dimension of the top and bottom plies of its associated packet to provide a fold space defined by transverse edges of adjacent assemblies, and at least one line of weakness in said top and bottom plies extending transversely of each packet slightly offset from at least one of said transverse edges and being positioned in said fold space, whereby the portions of said top and bottom plies in said fold space provide a waste strip to permit removal of a ticket upon demand without sacrifice of full printing of the succeeding ticket.

9. The structure of claim 8 in which a second line of weakness is provided in said fold space adjacent the other of said transverse edges whereby said series is adapted to be folded along said second line of weakness, a typed ticket detached there along from said series and thereafter trimmed by tearing along the first mentioned line of weakness.

10. The structure of claim 8 in which a second line of weakness is provided in said fold space adjacent the other of said transverse edges whereby said series is adapted to be folded along either of said lines of weakness, a typed ticket detached from said series along a first of said lines of weakness and thereafter trimmed be tearing along the other of said lines of weakness.

11. The structure of claim 10 in which said series when installed in a typewriter has said second line of weakness positioned outwardly of said first mentioned line of weakness.

12. The structure of claim 8 in which said tickets are equipped with printed indicia for reading the same and when oriented for reading, the said transverse edges define top and bottom transverse edges, said line of weakness being adjacent said top transverse edge.

13. A series of connected tickets comprising elongated coextensive top and bottom plies equipped with aligned control margins along at least one longitudinally-extending edge thereof and providing a succession of packets defining individual tickets, an interior ply assembly for each ticket packet between said top and bottom plies and captured in the control margin along one longitudinally-extending edge, each interior ply assembly having a longitudinally extending dimension shorter than the longitudinally-extending dimension of the top and bottom plies of its associated packet to provide a fold space defined by transverse edges of adjacent assemblies, each said ticket being equipped with printed indicia for reading the same by orienting said ticket in a manner so that said transverse edges define top and bottom transverse edges, and a line of weakness generally aligned with said top transverse edge whereby after a typed ticket is separated from said series by cutting said series transversely adjacent the bottom transverse edge of a ticket, said separated ticket is adapted to be trimmed by tear off removal of the portion thereof above said line of weakness.

14. A series of connected tickets comprising elongated coextensive top and bottom plies equipped with aligned control margins along at least one longitudinally-extending edge thereof and providing a succession of packets defining individual tickets, an interior ply assembly for each ticket packet between said top and bottom plies and fastened in the control margin along said one longitudinally-extending edge, each interior ply assembly having a longitudinally-extending dimension shorter than the longitudinally-extending dimension of the top and bottom plies of its associated packet to provide a fold space defined by transverse edges of adjacent assemblies, said tickets being equipped with printed indicia for reading the same whereby when a ticket is oriented for reading said transverse edges define top and bottom transverse edges of a ticket, and two lines of weakness in each said top and bottom ply in the fold space thereof generally aligned with both said top and bottom transverse edges whereby a typed ticket is detachable from said series by tearing along a line of weakness associated with said bottom transverse edge and thereafter trimmed by tearing of the portions of said top and bottom plies above the line of weakness generally aligned with said top transverse edge.

* * * * *